US006929714B2

(12) United States Patent
Hu et al.

(10) Patent No.: US 6,929,714 B2
(45) Date of Patent: Aug. 16, 2005

(54) TISSUE PRODUCTS HAVING REDUCED SLOUGH

(75) Inventors: Sheng-Hsin Hu, Appleton, WI (US); Strong C. Chuang, Appleton, WI (US); Amber Marie Fortune, Kaukauna, WI (US); Jason D. Rottier, Kimberly, WI (US); Daniel John Vander Heiden, Menasha, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/830,627

(22) Filed: Apr. 23, 2004

(65) Prior Publication Data

US 2004/0194901 A1 Oct. 7, 2004

Related U.S. Application Data

(62) Division of application No. 10/267,050, filed on Oct. 8, 2002, now Pat. No. 6,752,905.

(51) Int. Cl.[7] ..... D21H 21/16; D21H 23/24

(52) U.S. Cl. ..... 162/127; 162/204; 162/169; 162/158; 162/125; 162/123; 162/135; 428/340; 428/537.5

(58) Field of Search ..... 162/109, 111–113, 162/123–125, 127, 135, 169, 204; 428/340–341, 152–154, 537.5

(56) References Cited

U.S. PATENT DOCUMENTS

| | | | | |
|---|---|---|---|---|
| 2,345,543 | A | | 3/1944 | Wohnsiedler et al. |
| 2,745,744 | A | | 5/1956 | Weidner et al. |
| 2,926,116 | A | | 2/1960 | Keim |
| 2,926,154 | A | | 3/1960 | Keim |
| 3,104,198 | A | | 9/1963 | Brissette |
| 3,256,138 | A | | 6/1966 | Welch et al. |
| 3,556,932 | A | | 1/1971 | Coscia et al. |
| 3,556,933 | A | | 1/1971 | Williams et al. |
| 3,695,985 | A | * | 10/1972 | Brook et al. ..... 428/152 |
| 3,700,623 | A | | 10/1972 | Keim |
| 3,772,076 | A | | 11/1973 | Keim |
| 3,812,000 | A | | 5/1974 | Salvucci, Jr. et al. |
| 3,821,068 | A | | 6/1974 | Shaw |
| 3,844,880 | A | | 10/1974 | Meisel, Jr. et al. |
| 3,862,877 | A | | 1/1975 | Camden |
| 3,879,257 | A | | 4/1975 | Gentile et al. |
| 3,885,158 | A | | 5/1975 | Flutie et al. |
| 3,899,388 | A | | 8/1975 | Petrovich et al. |
| 3,903,342 | A | | 9/1975 | Roberts, Jr. |
| 3,994,771 | A | | 11/1976 | Morgan et al. |
| 4,018,647 | A | | 4/1977 | Wietsma |
| 4,057,669 | A | | 11/1977 | McConnell |
| 4,064,213 | A | * | 12/1977 | Lazorisak et al. ..... 264/134 |
| 4,081,318 | A | | 3/1978 | Wietsma |
| 4,099,913 | A | | 7/1978 | Walter et al. |
| 4,121,966 | A | | 10/1978 | Amano et al. |
| 4,125,659 | A | | 11/1978 | Klowak et al. |
| 4,129,528 | A | | 12/1978 | Petrovich et al. |
| 4,147,586 | A | | 4/1979 | Petrovich et al. |
| 4,158,594 | A | | 6/1979 | Becker et al. |
| 4,208,459 | A | | 6/1980 | Becker et al. |
| 4,222,921 | A | | 9/1980 | Van Eenam |
| 4,237,818 | A | | 12/1980 | Clifford et al. |
| 4,326,000 | A | | 4/1982 | Roberts, Jr. |
| 4,351,699 | A | | 9/1982 | Osborn, III |
| 4,392,861 | A | | 7/1983 | Butterworth et al. |
| 4,441,962 | A | | 4/1984 | Osborn, III |
| 4,445,972 | A | * | 5/1984 | Bartelloni ..... 162/164.1 |
| 4,447,294 | A | | 5/1984 | Osborn, III |
| 4,507,173 | A | | 3/1985 | Klowak et al. |
| 4,510,019 | A | | 4/1985 | Bartelloni |
| 4,581,254 | A | | 4/1986 | Cunningham et al. |
| 4,603,176 | A | | 7/1986 | Bjorkquist et al. |
| 4,604,313 | A | | 8/1986 | McFarland et al. |
| 4,605,702 | A | | 8/1986 | Guerro et al. |
| 4,755,421 | A | | 7/1988 | Manning et al. |
| 4,795,668 | A | | 1/1989 | Krueger et al. |
| 4,822,452 | A | | 4/1989 | Tse et al. |
| 4,849,054 | A | | 7/1989 | Klowak |
| 4,886,579 | A | * | 12/1989 | Clark et al. ..... 162/111 |
| 4,925,528 | A | | 5/1990 | Tse et al. |
| 4,940,513 | A | | 7/1990 | Spendel |
| 4,959,125 | A | | 9/1990 | Spendel |
| 5,019,211 | A | | 5/1991 | Sauer |
| 5,048,589 | A | | 9/1991 | Cook et al. |
| 5,057,368 | A | | 10/1991 | Largman et al. |

(Continued)

FOREIGN PATENT DOCUMENTS

| | | |
|---|---|---|
| EP | 0404189 A1 | 12/1990 |
| EP | 0465203 B1 | 1/1992 |
| EP | 0951603 | 8/2002 |
| EP | 1243697 A1 | 9/2002 |
| EP | 1243697 | 9/2002 |
| WO | WO 9925924 A1 | 5/1999 |
| WO | WO 0021918 A1 | 4/2000 |
| WO | WO 0112902 A1 | 2/2001 |
| WO | WO 0112902 | 2/2001 |
| WO | WO 0202871 A1 | 1/2002 |
| WO | WO 0202871 | 1/2002 |
| WO | WO 0214606 | 2/2002 |
| WO | WO 0216689 A2 | 2/2002 |

OTHER PUBLICATIONS

U.S. Appl. No. 10/005,882.
U.S. Appl. No. 10/319,415.

*Primary Examiner*—José A. Fortuna
(74) *Attorney, Agent, or Firm*—Dority & Manning, P.A.

(57) ABSTRACT

A method for forming a tissue product that is soft and produces relatively low levels of slough is provided. The method includes providing a liquid furnish of cellulosic fibers and forming a multi-layered wet web therefrom. The web is dried (e.g., through-dried) to a solids consistency of 90% or greater. A latex having a glass transition temperature less than about 30° C. is applied to the dried web (e.g., foamed, printed, sprayed, etc.) such that the latex comprises less than about 3% by weight of the dry weight of the web. The latex remains substantially uncured after being applied to the dried web.

19 Claims, 6 Drawing Sheets

U.S. PATENT DOCUMENTS 5,069,970 A 12/1991 Largman et al.
5,094,717 A 3/1992 Manning et al.
5,102,501 A 4/1992 Eber et al.
5,108,820 A 4/1992 Kaneko et al.
5,129,988 A 7/1992 Farrington, Jr.
5,162,074 A 11/1992 Hills
5,164,046 A 11/1992 Ampulski et al.
5,167,765 A 12/1992 Nielsen et al.
5,238,534 A 8/1993 Manning et al.
5,240,562 A 8/1993 Phan et al.
5,277,976 A 1/1994 Hogle et al.
5,336,552 A 8/1994 Strack et al.
5,382,400 A 1/1995 Pike et al.
5,385,643 A 1/1995 Ampulski
5,397,435 A 3/1995 Ostendorf et al.
5,399,412 A 3/1995 Sudall et al.
5,405,501 A 4/1995 Phan et al.
5,409,768 A 4/1995 Dickenson et al.
5,427,696 A 6/1995 Phan et al.
5,437,766 A 8/1995 Van Phan et al.
5,466,337 A 11/1995 Darlington et al.
5,466,410 A 11/1995 Hills
5,494,554 A 2/1996 Edwards et al.
5,510,000 A 4/1996 Phan et al.
5,510,001 A 4/1996 Hermans et al.
5,529,665 A 6/1996 Kaun
5,543,067 A 8/1996 Phan et al.
5,558,873 A 9/1996 Funk et al.
5,591,309 A 1/1997 Rugowski et al.
5,667,636 A 9/1997 Engel et al.
5,716,498 A 2/1998 Jenny et al.
5,730,839 A 3/1998 Wendt et al.
5,846,380 A 12/1998 Van Phan et al.
5,851,352 A 12/1998 Vinson et al.
5,853,539 A 12/1998 Smith et al.
5,885,418 A 3/1999 Anderson et al.
5,935,383 A 8/1999 Sun et al.
5,981,044 A 11/1999 Phan et al.
5,981,410 A 11/1999 Hansen et al.
5,985,434 A 11/1999 Qin et al.
5,989,682 A 11/1999 Anderson
5,993,602 A 11/1999 Smith et al.
6,017,417 A 1/2000 Wendt et al.
6,017,418 A 1/2000 Oriaran et al.
6,096,152 A 8/2000 Anderson et al.
6,129,815 A 10/2000 Larson et al.
6,200,669 B1 3/2001 Marmon et al.
6,211,139 B1 4/2001 Keys et al.
6,231,719 B1 5/2001 Garvey et al.
6,241,850 B1 6/2001 Kelly
6,248,211 B1 6/2001 Jennings et al.
6,248,212 B1 6/2001 Anderson et al.
6,261,580 B1 7/2001 Lehrter et al.
6,277,241 B1 8/2001 Merker et al.
6,315,864 B2 11/2001 Anderson et al.
6,328,850 B1 12/2001 Phan et al.
6,368,609 B1 4/2002 Fontenot et al.
6,387,495 B1 5/2002 Reeves et al.
6,423,180 B1 7/2002 Behnke et al.
6,432,270 B1 8/2002 Liu et al.
6,500,289 B2 12/2002 Merker et al.
6,534,151 B2 3/2003 Merker
2002/0084048 A1 7/2002 Merker et al.
2002/0088592 A1 7/2002 Drew et al.
2003/0024667 A1 * 2/2003 Wallenius et al. ..... 162/109
2003/0131962 A1 7/2003 Lindsay et al.
2004/0065422 A1 4/2004 Hu et al.

* cited by examiner

TISSUE PRODUCTS HAVING REDUCED SLOUGH

The present application is a divisional of U.S. application Ser. No. 10/267,050 filed on Oct. 8, 2002 now U.S. Pat. No. 6,752,905.

BACKGROUND OF THE INVENTION

Tissue products, such as facial tissues, paper towels, bath tissues, sanitary napkins, and other similar products, are designed to include several important properties. For example, the products should have good bulk, a soft feel, and should have good strength. Unfortunately, however, when steps are taken to increase one property of the product, other characteristics of the product are often adversely affected.

For example, during a papermaking process, it is common to use various resins to increase the wet strength of the web. Cationic resins, for example, are often used because they are believed to more readily bond to the anionically charged cellulosic fibers. In addition, resins that are anionic in nature have also been utilized. U.S. Pat. No. 3,844,880 to Meisel, Jr., et al., for instance, describes anionic styrene-butadiene latexes that are adhered to the anionic cellulosic fibers with a deposition aid. Although strength resins can increase the strength of the web, they also tend to stiffen the web, which is often undesired by consumers. Thus, various methods are often used to counteract this stiffness and to soften the product. For example, chemical debonders can be utilized to reduce fiber bonding and thereby increase softness.

Nevertheless, reducing fiber bonding with a chemical debonder can sometimes adversely affect the strength of the tissue product. For example, hydrogen bonds between adjacent fibers can be broken by such chemical debonders, as well as by mechanical forces of a papermaking process. Consequently, such debonding results in loosely bound fibers that extend from the surface of the tissue product. During processing and/or use, these loosely bound fibers create zones of fibers that are poorly bound to each-other and adjacent zones of fibers. As a result, during use, certain shear forces can liberate the weakly bound zones from the remaining fibers, thereby resulting in slough, i.e., bundles or pills on surfaces, such as skin or fabric. Thus, the use of such debonders can sometimes result in a much weaker paper product during use that exhibits substantial amounts of slough.

As such, a need currently exists for a tissue product that is strong, soft, and that also has low slough.

SUMMARY OF THE INVENTION

In accordance with one embodiment of the present invention, a method is provided for forming a tissue product. The method includes providing a liquid furnish of cellulosic fibers and forming a multi-layered wet web from the liquid furnish of cellulosic fibers. The wet web is dried to a solids consistency of about 90% or greater, such as with one or more through-dryers. At least one latex (e.g., nonionic or anionic) is applied to the dried web (e.g., foamed, printed, sprayed, etc.) in an amount less than about 3% of the dry weight of said web, in some embodiments, from about 0.1% to about 1.5% of the dry weight of the web, and in some embodiments, from about 0.5% to about 1% of the dry weight of the web. The latex remains substantially uncured after being applied to the dried web. For instance, in some embodiments, the dried web remains at a temperature below about 130° C. after being applied with the latex. The latex has a glass transition temperature that is less than about 30° C., and in some embodiments, that is also greater than about −25° C. For example, in some embodiments, the glass transition temperature is from about −15° C. to about 15° C., and in some embodiments, from about −10° C. to about 0° C. The latex can be selected from the group consisting of styrene-butadiene copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, and nitrile polymers.

In some embodiments, the surface of the multi-layered dried web has elevated regions and non-elevated regions. The latex may be applied to the dried web such that a greater amount of the latex resides on the elevated regions than on the non-elevated regions. Generally, the latex may be applied to the web in a variety of ways. For instance, the latex may be applied to the web as a foam composition. The foam composition may have a blow ratio greater than about 3:1 before being applied to the dried web. Alternatively, the latex may be applied by printing, spraying, as well as other techniques.

In accordance with another embodiment of the present invention, a tissue product is disclosed that comprises a multi-layered paper web having at least one outer layer that defines an outer surface of the tissue product. The outer layer comprises a substantially uncured latex having a glass transition temperature less than about 30° C. and greater than about −25° C. If desired, one or more of the remaining layers of the multi-layered paper web may remain substantially free of the latex.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
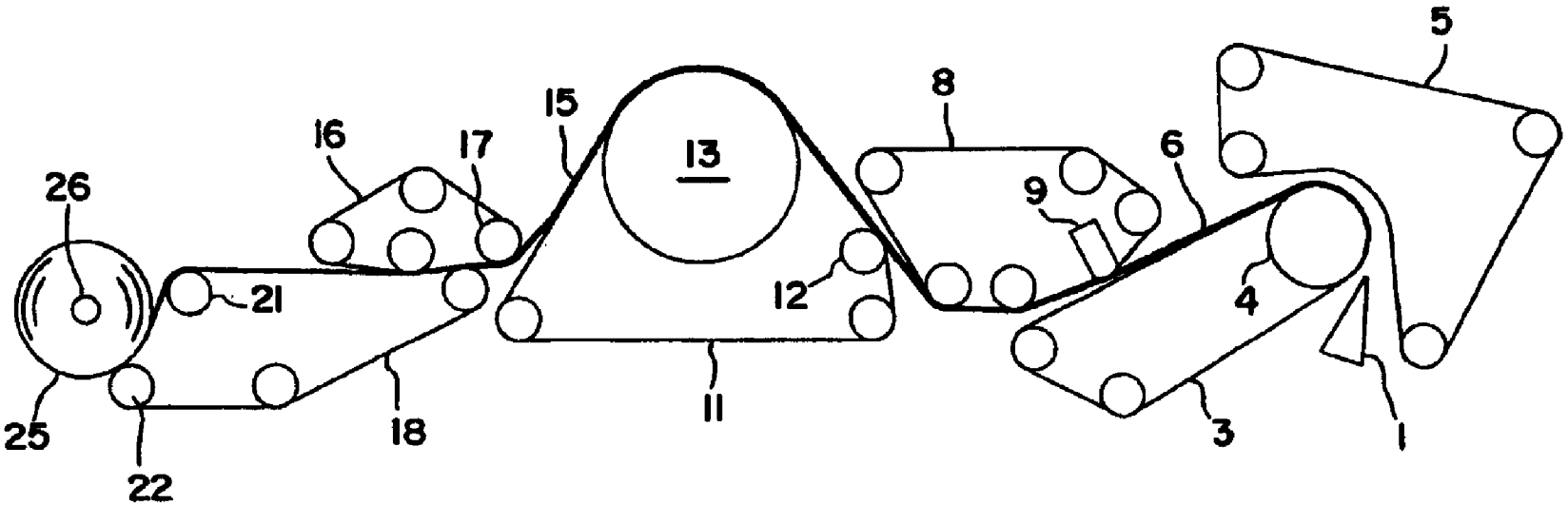
FIG. 1 is a schematic flow diagram of one embodiment of a papermaking process that can be used in the present invention.

Repeat use of reference characters in the present specification and drawings is intended to represent same or analogous features or elements of the present invention.

DETAILED DESCRIPTION OF REPRESENTATIVE EMBODIMENTS

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention covers such modifications and variations as come within the scope of the appended claims and their equivalents.

In general, the present invention is directed to a tissue product containing a multi-layered paper web that has at least one outer fibrous layer treated with a latex. The latex can form a thin film layer on the fiber surface that prevents fibers or zones of fibers from breaking away from the surface as lint or slough. As used herein, a "tissue product" generally refers to various paper products, such as facial tissue, bath tissue, paper towels, napkins, and the like. Normally, the basis weight of a tissue product of the present invention is less than about 80 grams per square meter (gsm), in some embodiments less than about 60 grams per square meter, and in some embodiments, from about 10 to about 60 gsm.

Any of a variety of materials can also be used to form the paper web(s) of the tissue product. For example, the material used to make the tissue product can include fibers formed by a variety of pulping processes, such as kraft pulp, sulfite pulp, thermomechanical pulp, etc. The pulp fibers may include softwood fibers having an average fiber length of greater than 1 mm and particularly from about 2 to 5 mm based on a length-weighted average. Such softwood fibers can include, but are not limited to, northern softwood, southern softwood, redwood, red cedar, hemlock, pine (e.g., southern pines), spruce (e.g., black spruce), combinations thereof, and the like. Exemplary commercially available pulp fibers suitable for the present invention include those available from Kimberly-Clark Corporation under the trade designations "Longlac-19".

Hardwood fibers, such as eucalyptus, maple, birch, aspen, and the like, can also be used. In certain instances, eucalyptus fibers may be particularly desired to increase the softness of the web. Eucalyptus fibers can also enhance the brightness, increase the opacity, and change the pore structure of the web to increase its wicking ability. Moreover, if desired, secondary fibers obtained from recycled materials may be used, such as fiber pulp from sources such as, for example, newsprint, reclaimed paperboard, and office waste. Further, other natural fibers can also be used in the present invention, such as abaca, sabai grass, milkweed floss, pineapple leaf, and the like. In addition, in some instances, synthetic fibers can also be utilized. Some suitable synthetic fibers can include, but are not limited to, rayon fibers, ethylene vinyl alcohol copolymer fibers, polyolefin fibers, polyesters, and the like.

As stated above, the tissue product of the present invention contains at least one multi-layered paper web. The tissue product can be a single-ply tissue product in which the web forming the tissue is stratified, i.e., has multiple layers, or a multi-ply tissue product in which the webs forming the multi-ply tissue product may themselves be either single or multi-layered. For instance, in one embodiment, a tissue product contains a ply formed from three layers where the outer layers include eucalyptus fibers and the inner layer includes northern softwood kraft fibers. If desired, the layers may also include blends of various types of fibers. However, it should be understood that the tissue product can include any number of plies or layers and can be made from various types of fibers.

In accordance with the present invention, a latex is applied to the cellulosic fibers to reduce lint and slough of the resulting tissue product. Specifically, the latex can form a thin film layer on the fiber surface that prevents fibers or zones of fibers from breaking away from the surface as lint or slough. As used herein, a "latex" generally refers to a natural or synthetic colloidal dispersion of a polymeric material in a liquid system that is primarily aqueous in nature. Latexes suitable for use in the present invention typically have a glass transition temperature less than about 30° C. so that the flexibility of the resulting web is not substantially restricted. Moreover, the latexes also typically have a glass transition temperature greater than about −25° C. to minimize the tackiness of the latex. For instance, in some embodiments, the latexes used in the present invention have a glass transition temperature from about −15° C. to about 15° C., and in some embodiments, from about −10° C. to about 0° C.

Although not required, the latexes used in the present invention are typically nonionic or anionic to facilitate application to the paper web. For instance, some suitable latexes that can be utilized in the present invention include, but are not limited to, anionic styrene-butadiene copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, nitrile polymers, and any other suitable anionic latex polymers known in the art. The charge (e.g., anionic or nonionic) of the latexes described above can be readily varied, as is well known in the art, by utilizing a stabilizing agent having the desired charge during preparation of the latex. Other examples of suitable latexes may be described in U.S. Pat. No. 3,844,880 to Meisel, Jr., et al., which is incorporated herein in its entirety by reference thereto for all purposes.

Generally speaking, the latex remains substantially uncured after being applied to the paper web. When latex is cured, it polymerizes or crosslinks with itself and/or the cellulosic fibers of the web, thereby increasing the stiffness of the resulting web. For most latexes, substantial curing begins at around a temperature of 130° C. or greater. To ensure that the latex remains substantially uncured, it is typically desired that the web remain below about 130° C. after application of the latex, and in some embodiments, below about 105° C. Thus, because conventional paper web drying often involves relatively high temperatures, the latex is applied at a stage of the papermaking process in which the web has already been substantially dried. This stage is commonly referred to as the "dry end" of a papermaking process, i.e., any stage of the papermaking process that occurs after the web is dried to a solids consistency of greater than about 90% by weight, and in some embodiments, greater than about 95% by weight. In fact, if desired, the web may not be subjected to any further drying step(s) after being applied with the latex. However, it should be understood that the web may be exposed to some level of drying after application of the latex. For instance, a latex-treated web that is still partially wet may be dried at lower temperatures, e.g., below about 105° C., to complete the drying of the web.

To further minimize the stiffness of the multi-layered paper web used to form the tissue product, a variety of different techniques can be utilized. For instance, the latex can be applied in relatively small amounts. In some embodiments, the latex is applied in an amount less than 60 pounds per ton (lb/T), in some embodiments from about 2 lb/T to about 30 lb/MT, and in some embodiments, from about 5 lb/MT to about 20 lb/MT of the dry weight of the fibrous material within the web. In addition, the latex is also typically applied in amounts less than about 3%, in some embodiments from about 0.1% to about 1.5%, and in some embodiments, from about 0.5% to about 1% of the dry weight of the fibrous material within the web.

Further, the stiffness of the web can also be reduced by restricting application of the latex to only the outer layers of the web, particularly when the web is used in a single ply tissue product. For instance, in one embodiment, a single ply tissue product can contain a three-layered paper web in which one outer layer contains the latex, while the inner layer and other outer layer are substantially free of the latex. It should be understood that, when referring to a layer that is "substantially free" of the latex, minuscule amounts of latex may be present therein. However, such small amounts often arise from the latex applied to the outer layer, and do not typically substantially affect the stiffness of the tissue product.

If desired, various papermaking additives may also be applied to the web, either separately or in conjunction with the latex. For example, in some embodiments, a wet strength agent can be utilized, to further increase the strength of the tissue product and optionally to aid in the deposition of the latex. As used herein, a "wet strength agent" is any material that, when added to cellulosic fibers, can provide a resulting web or sheet with a wet geometric tensile strength to dry geometric tensile strength ratio in excess of about 0.1. Typically these materials are termed either "permanent" wet strength agents or "temporary" wet strength agents. As is well known in the art, temporary and permanent wet strength agents may also sometimes function as dry strength agents to enhance the strength of the tissue product when dry.

Suitable permanent wet strength agents are typically water soluble, cationic oligomeric or polymeric resins that are capable of either crosslinking with themselves (homocrosslinking) or with the cellulose or other constituents of the wood fiber. Examples of such compounds are described in U.S. Pat. Nos. 2,345,543; 2,926,116; and 2,926,154, which are incorporated herein in their entirety by reference thereto for all purposes. One class of such agents includes polyamine-epichlorohydrin, polyamide epichlorohydrin or polyamide-amine epichlorohydrin resins, collectively termed "PAE resins". Examples of these materials are described in U.S. Pat. No. 3,700,623 to Keim and U.S. Pat. No. 3,772,076 to Keim, which are incorporated herein in their entirety by reference thereto for all purposes and are sold by Hercules, Inc., Wilmington, Del. under the trade designation "Kymene", e.g., Kymene 557H or 557 LX. Kymene 557 LX, for example, is a polyamide epicholorohydrin polymer that contains both cationic sites, which can form ionic bonds with anionic groups on the pulp fibers, and azetidinium groups, which can form covalent bonds with carboxyl groups on the pulp fibers and crosslink with the polymer backbone when cured. Other suitable materials include base-activated polyamide-epichlorohydrin resins, which are described in U.S. Pat. No. 3,885,158 to Petrovich; U.S. Pat. No. 3,899,388 to Petrovich; U.S. Pat. No. 4,129,528 to Petrovich; U.S. Pat. No. 4,147,586 to Petrovich; and U.S. Pat. No. 4,222,921 to van Eanam, which are incorporated herein in their entirety by reference thereto for all purposes. Polyethylenimine resins may also be suitable for immobilizing fiber-fiber bonds. Another class of permanent-type wet strength agents includes aminoplast resins (e.g., urea-formaldehyde and melamine-formaldehyde).

Temporary wet strength agents can also be useful in the present invention. Suitable temporary wet strength agents can be selected from agents known in the art such as dialdehyde starch, polyethylene imine, mannogalactan gum, glyoxal, and dialdehyde mannogalactan. Also useful are glyoxylated vinylamide wet strength resins as described in U.S. Pat. No. 5,466,337 to Darlington, et al., which is incorporated herein in its entirety by reference thereto for all purposes. Useful water-soluble resins include polyacrylamide resins such as those sold under the Parez trademark, such as Parez 631NC, by American Cyanamid Company of Stanford, Conn. Such resins are generally described in U.S. Pat. No. 3,556,932 to Coscia, et al. and U.S. Pat. No. 3,556,933 to Williams, et al., which are incorporated herein in their entirety by reference thereto for all purposes. For example, the "Parez" resins typically include a polyacrylamide-glyoxal polymer that contains cationic hemiacetal sites that can form ionic bonds with carboxyl or hydroxyl groups present on the cellulosic fibers. These bonds can provide increased strength to the web of pulp fibers. In addition, because the hemicetal groups are readily hydrolyzed, the wet strength provided by such resins is primarily temporary. U.S. Pat. No. 4,605,702 to Guerro, et al., which is incorporated herein in its entirety by reference thereto for all purposes, also describes suitable temporary wet strength resins made by reacting a vinylamide polymer with glyoxal, and then subjecting the polymer to an aqueous base treatment. Similar resins are also described in U.S. Pat. No. 4,603,176 to Biorkquist, et al.; U.S. Pat. No. 5,935,383 to Sun, et al.; and U.S. Pat. No. 6,017,417 to Wendt, et al., which are incorporated herein in their entirety by reference thereto for all purposes.

A chemical debonder can also be applied to soften the web and optionally to aid in the deposition of the latex on the web. Specifically, a chemical debonder can reduce the amount of hydrogen bonds within one or more layers of the web, which results in a softer product. Any material that can be applied to cellulosic fibers and that is capable of enhancing the soft feel of a web by disrupting hydrogen bonding can generally be used as a debonder in the present invention. In particular, as stated above, it is typically desired that the debonder possess a cationic charge for forming an ionic bond with anionic groups present on the cellulosic fibers. Some examples of suitable cationic debonders can include, but are not limited to, quaternary ammonium compounds, imidazolinium compounds, bis-imidazolinium compounds, diquaternary ammonium compounds, polyquaternary ammonium compounds, ester-functional quaternary ammonium compounds (e.g., quaternized fatty acid trialkanolamine ester salts), phospholipid derivatives, polydimethylsiloxanes and related cationic and non-ionic silicone compounds, fatty & carboxylic acid derivatives, mono- and polysaccharide derivatives, polyhydroxy hydrocarbons, etc. For instance, some suitable debonders are described in U.S. Pat. No. 5,716,498 to Jenny, et al.; U.S. Pat. No. 5,730,839 to Wendt, et al.; U.S. Pat. No. 6,211,139 to Keys, et al.; U.S. Pat. No. 5,543,067 to Phan, et al.; and WO/0021918, which are incorporated herein in their entirety by reference thereto for all purposes. For instance, Jenny et al. and Phan, et al. describe various ester-functional quaternary ammonium debonders (e.g., quaternized fatty acid trialkanolamine ester salts) suitable for use in the present invention. In addition, Wendt, et al. describes imidazolinium quaternary debonders that may be suitable for use in the present invention. Further, Keys, et al. describes polyester polyquaternary ammonium debonders that may be useful in the present invention. Still other suitable debonders are disclosed in U.S. Pat. No. 5,529,665 to Kaun and U.S. Pat. No. 5,558,873 to Funk, et al., which are incorporated herein in their entirety by reference thereto for all purposes. In particular, Kaun discloses the use of various cationic silicone compositions as softening agents.

A tissue product made in accordance with the present invention can generally be formed according to a variety of papermaking processes known in the art. In fact, any process capable of making a paper web can be utilized in the present invention. For example, a papermaking process of the present invention can utilize wet-pressing, creping, through-air-drying, creped through-air-drying, uncreped through-air-drying, single recreping, double recreping, calendering, embossing, air laying, as well as other steps in processing the paper web. For instance, papermaking processes suitable for forming a multi-layered paper web are described in U.S. Pat. No. 5,129,988 to Farrington, Jr.; U.S. Pat. No. 5,494,554 to Edwards, et al.; and U.S. Pat. No. 5,529,665 to Kaun, which are incorporated herein in their entirety by reference thereto for all purposes.

One particular embodiment of the present invention utilizes an uncreped through-drying technique to form the tissue. Through-air drying can increase the bulk and softness of the web. Examples of such a technique are disclosed in U.S. Pat. No. 5,048,589 to Cook, et al.; U.S. Pat. No. 5,399,412 to Sudall, et al.; U.S. Pat. No. 5,510,001 to Hermans, et al.; U.S. Pat. No. 5,591,309 to Rugowski, et al.; U.S. Pat. No. 6,017,417 to Wendt, et al., and U.S. Pat. No. 6,432,270 to Liu, et al., which are incorporated herein in their entirety by reference thereto for all purposes. Uncreped through-drying generally involves the steps of: (1) forming a furnish of cellulosic fibers, water, and optionally, other additives; (2) depositing the furnish on a traveling foraminous belt, thereby forming a fibrous web on top of the traveling foraminous belt; (3) subjecting the fibrous web to through-drying to remove the water from the fibrous web; and (4) removing the dried fibrous web from the traveling foraminous belt.

For example, referring to FIG. 1, one embodiment of a papermaking machine that can be used in forming an uncreped through-dried tissue product is illustrated. For simplicity, the various tensioning rolls schematically used to define the several fabric runs are shown but not numbered. As shown, a papermaking headbox 1 can be used to inject or deposit a stream of an aqueous suspension of papermaking fibers onto an inner forming fabric 3 as it transverses the forming roll 4. An outer forming fabric 5 serves to contain the web 6 while it passes over the forming roll 4 and sheds some of the water. If desired, dewatering of the wet web 6 can be carried out, such as by vacuum suction, while the wet web 6 is supported by the forming fabric 3.

The wet web 6 is then transferred from the forming fabric 3 to a transfer fabric 8 while at a solids consistency of from about 10% to about 35%, and particularly, from about 20% to about 30%. As used herein, a "transfer fabric" is a fabric that is positioned between the forming section and the drying section of the web manufacturing process. The transfer fabric 8 may be a patterned fabric having protrusions or impression knuckles, such as described in U.S. Pat. No. 6,017,417 to Wendt et al. Typically, the transfer fabric 8 travels at a slower speed than the forming fabric 3 to enhance the "MD stretch" of the web, which generally refers to the stretch of a web in its machine or length direction (expressed as percent elongation at sample failure). For example, the relative speed difference between the two fabrics can be from 0% to about 80%, in some embodiments greater than about 10%, in some embodiments from about 10% to about 60%, and in some embodiments, from about 15% to about 30%. This is commonly referred to as "rush" transfer. One useful method of performing rush transfer is taught in U.S. Pat. No. 5,667,636 to Engel et al., which is incorporated herein in its entirety by reference thereto for all purposes.

Transfer to the fabric 8 may be carried out with the assistance of positive and/or negative pressure. For example, in one embodiment, a vacuum shoe 9 can apply negative pressure such that the forming fabric 3 and the transfer fabric 8 simultaneously converge and diverge at the leading edge of the vacuum slot. Typically, the vacuum shoe 9 supplies pressure at levels from about 10 to about 25 inches of mercury. As stated above, the vacuum transfer shoe 9 (negative pressure) can be supplemented or replaced by the use of positive pressure from the opposite side of the web to blow the web onto the next fabric. In some embodiments, other vacuum shoes can also be used to assist in drawing the fibrous web 6 onto the surface of the transfer fabric 8.

From the transfer fabric 8, the fibrous web 6 is then transferred to the through-drying fabric 11 with the aid of a vacuum transfer roll 12. When the wet web 6 is transferred to the fabric 11. While supported by the through-drying fabric 11, the web 6 is then dried by a through-dryer 13 to a solids consistency of about 90% or greater, and in some embodiments, about 95% or greater. The through-dryer 13 accomplishes the removal of moisture by passing air therethrough without applying any mechanical pressure. Through-drying can also increase the bulk and softness of the web. In one embodiment, for example, the through-dryer 13 can contain a rotatable, perforated cylinder and a hood for receiving hot air blown through perforations of the cylinder as the through-drying fabric 11 carries the web 6 over the upper portion of the cylinder. The heated air is forced through the perforations in the cylinder of the through-dryer 13 and removes the remaining water from the web 6. The temperature of the air forced through the web 6 by the through-dryer 13 can vary, but is typically from about 100° C. to about 250° C. There can be more than one through-dryer in series (not shown), depending on the speed and the dryer capacity. It should also be understood that other non-compressive drying methods, such as microwave or infrared heating, can be used. Further, compressive drying methods, such as drying with the use of a Yankee dryer, may also be used in the present invention.

The dried tissue sheet 15 is then transferred to a first dry end transfer fabric 16 with the aid of vacuum transfer roll 17. The tissue sheet shortly after transfer is sandwiched between the first dry end transfer fabric 16 and a transfer belt 18 to positively control the sheet path. The air permeability of the transfer belt 18 may be lower than that of the first dry end transfer fabric 16, causing the sheet to naturally adhere to the transfer belt 18. At the point of separation, the sheet 15 follows the transfer belt 18 due to vacuum action. Suitable low air permeability fabrics for use as the transfer belt 18 include, without limitation, COFPA Mononap NP 50 dryer felt (air permeability of about 50 cubic feet per minute per square foot) and Asten 960C (impermeable to air). The transfer belt 18 passes over two winding drums 21 and 22 before returning to again pick up the dried tissue sheet 15. The sheet 15 is transferred to a parent roll 25 at a point between the two winding drums. The parent roll 25 is wound onto a reel spool 26, which is driven by a center drive motor.

As indicated above, the latex is applied to the web 15 at any point of the papermaking process after the web 15 is substantially dried. One particularly beneficial method is to apply latex to the surface of the web using rotogravure or gravure printing, either direct or indirect (offset). Gravure printing encompasses several well-known engraving techniques, such as mechanical engraving, acid-etch engraving, electronic engraving and ceramic laser engraving. Such printing techniques provide excellent control of the composition distribution and transfer rate. Gravure printing may provide, for example, from about 10 to about 1000 deposits per lineal inch of surface, or from about 100 to about 1,000,000 deposits per square inch. Each deposit results from an individual cell on a printing roll, so that the density of the deposits corresponds to the density of the cells. A suitable electronic engraved example for a primary delivery zone is about 200 deposits per lineal inch of surface, or about 40,000 deposits per square inch. By providing such a large number of small deposits, the uniformity of the deposit distribution may be enhanced. Also, because of the large number of small deposits applied to the surface of the web, the deposits more readily resolidify on the surface where they are most effective in reducing slough. As a consequence, a relatively low amount of the latex can be used to cover a large area. Suitable gravure printing techniques are also described in U.S. Pat. No. 6,231,719 to Garvey, et al., which is incorporated herein in its entirety by reference thereto for all purposes. Moreover, besides gravure printing, it should be understood that other printing techniques, such as flexographic printing, may also be used to apply the latex.

Figure 2:
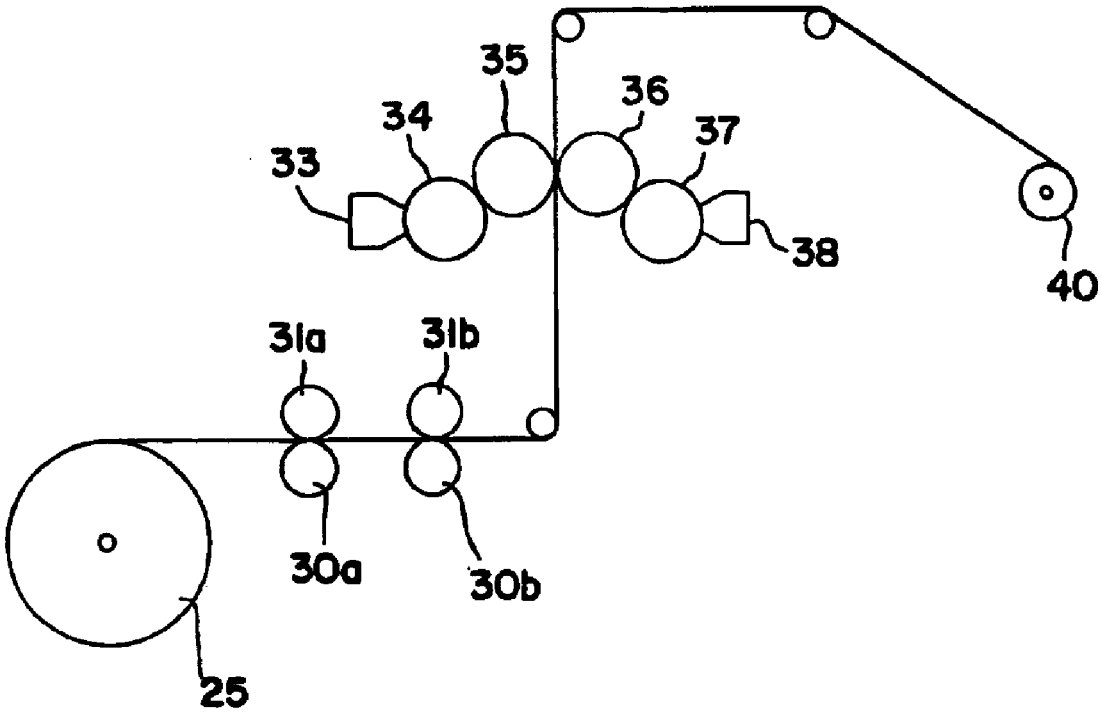
FIG. 2 is a schematic diagram of a method for rotogravure coating latex onto a web in accordance with one embodiment of the present invention.

For example, referring to FIG. 2, one embodiment of a method for applying the latex to web using rotogravure printing is illustrated. As shown, the parent roll 25 (See FIG. 1) is unwound and passed through two calender nips between calender rolls 30*a* and 31*a* and 30*b* and 31*b*. The calendered web is then passed to the rotogravure coating station that includes a first closed doctor chamber 33 containing the latex to be applied to a first side of the web, a first engraved steel gravure roll 34, a first rubber backing roll 35, a second rubber backing roll 36, a second engraved steel gravure roll 37, and a second closed doctor chamber 38 containing the latex to be applied to the second side of the web. If both sides of the web are to be treated, the two latexes can be the same or different. The calendered web passes through a fixed-gap nip between the two rubber backing rolls where the latex is applied to the web. The treated web is then passed to the rewinder where the web is wound onto logs 40 and slit into rolls of tissue.

Further, the latex may also be sprayed onto the dry web. Any equipment suitable for spraying an additive onto a paper web may be utilized in the present invention. For instance, one example of suitable spraying equipment includes external mix, air atomizing nozzles, such as the 2 mm nozzle available from V.I.B. Systems, Inc., Tucker, Ga. Another nozzle that can be used is an H ⅛" W-SS 650017 VeeJet spray nozzle available from Spraying Systems, Inc. of Milwaukee, Wis. Still other spraying techniques and equipment are described in U.S. Pat. No. 5,164,046 to Ampulski, et al., which is incorporated herein in its entirety by reference thereto for all purposes. In addition, besides the techniques referenced above, other well-known techniques for applying a composition to a dried web, such as extrusion, etc., may also be used in the present invention.

Figure 3:
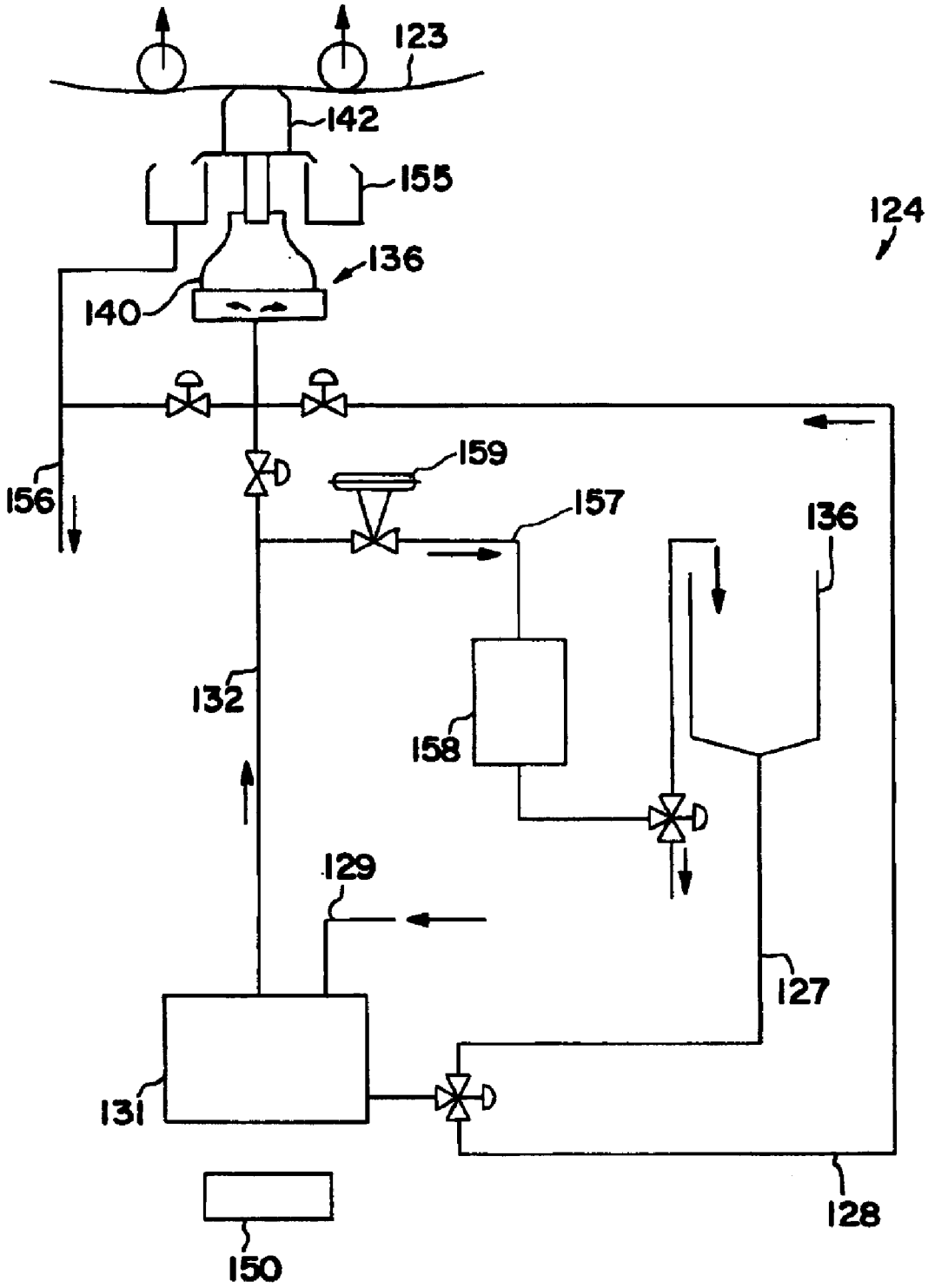
FIG. 3 is a schematic flow diagram of one embodiment of the present invention for foaming latex onto a paper web.

Besides the above-mentioned techniques, the latex may also be applied as a foam composition. For instance, several suitable techniques for forming a foam composition and applying the composition to a dry web are described in WO 02/16689, which is incorporated herein in its entirety by reference thereto for all purposes. In one embodiment, such as shown in FIG. 3, a foaming system 124 can be utilized to foam a composition onto the substantially dried web 123.

As shown, a foaming system 124 receives the latex from a tank 136. The latex is supplied to the foaming system 124 through a line 127. In some embodiments, as shown, a line 128 can also be utilized to supply water, recycled liquids, and/or other liquids to the foaming system 124 if desired. Although not required, water may, for example, aid in generating the foamed composition. Other compounds may also be applied to the foaming system, such as the reactive compositions described above. In addition, foaming aids may be applied to facilitate the generation of foam. Foaming aids that have a low critical miscelle concentration, are cationic and/or amphoteric, and have small bubble sizes are typically utilized. Some examples of suitable foaming aids include, but are not limited to, fatty acid amines, amides, and/or amine oxides; fatty acid quaternary compounds; electrolytes (to help achieve foam stability); and the like. Some commercially available foaming aids that are suitable in the present invention are Mackemium 516, Mackam 2C, and Mackam CBS-50G made by McIntyre Group, Ltd. When utilized, the foaming aids are generally incorporated into the liquid-based composition in amounts up to about 30% by weight of the liquid-based composition, and in some embodiments, from about 2% by weight to about 15% by weight. Other suitable foaming aids are described in U.S. Pat. No. 4,581,254 issued to Cunningham, et al., which is incorporated herein in its entirety by reference thereto for all purposes. Further other compositions, such as plasticizers (e.g., polyethylene glycol) may be combined with the latex to further reduce the stiffness of the web.

In one embodiment, the latex and/or other compounds can be metered to the foaming system 124 through the use of one or more conventional metering pumps, such as Moyno-style metering pumps. Moreover, in some embodiments, a mixer can also be provided to premix the latex with water before applying the liquids to the foaming system 124.

In addition to latex and/or other compounds, a gas, such as air, is also generally supplied to the foaming system 124. In particular, as shown, compressed air from a supply tank (not shown) is admitted to the foaming system 124 through a line 129 for mixing with the latex. For example, in one embodiment, compressed air is filtered and then metered into the foaming system 124 through a closed loop thermal mass flow meter and control valve.

Within the foaming system 124, a foam generator 131 combines the air, other compounds (if utilized), and the latex at a certain energy so that the foam can form. In one embodiment, for example, the foam generator 131 rotates at a certain speed so as to cause the liquid to pass through a series of edges, which allow trailing eddy currents of air to entrain into the liquid. In particular, the foam generator 131 can operate at speeds from about 300 rpm to about 700 rpm, and more particularly from about 400 rpm to about 600 rpm. For example, suitable foam generators are described in U.S. Pat. No. 4,237,818 to Clifford, et al., which is incorporated herein in its entirety by reference thereto for all purposes. Moreover, one commercially available foam generator that can be utilized in the present invention can be obtained from Gaston Systems, located in Stanley, N.C.

After generation, the foam is then forced out of the foam generator 131 into a conduit 132. The diameter of the conduit 132 can vary, depending on the desired amount of generated foam. For instance, in one embodiment, a conduit 132 having an inner diameter from about 0.375 inches to about 1.5 inches can be utilized to process about 300 to about 3000 cubic centimeters of air per minute and about 20 to about 300 grams of liquid per minute. Moreover, the conduit 132 can also have any desired length. For instance, in one embodiment, the length of the conduit 132 can be about 50 feet in length.

At the point in which the foam cells or bubbles enter the conduit 132, they are at their highest pressure. For instance, upon exiting the foam generator, the pressure can be from about 5 psi to about 90 psi, and more particularly from about 30 psi to about 60 psi. For example, in one embodiment, the pressure can be about 30 psi. Thereafter, the foam then travels under pressure through the conduit 132 into the foam applicator 136. As the foam moves up the conduit 132, the system backpressure is generally decreased. Due to this decrease in pressure, the size of the foam bubbles or cells generally increase such that the bubble sizes are greatest at the end of the conduit 132 adjacent to the foam applicator 136. In some embodiments, if desired, foam bubbles generated by the foam generator 131 can be recycled through the system 124 through a line 157, which utilizes a slot pressure control valve 159 to force the bubbles through a foam separator 158 that separates the liquid-based composition from the foam for further use.

Figure 4:
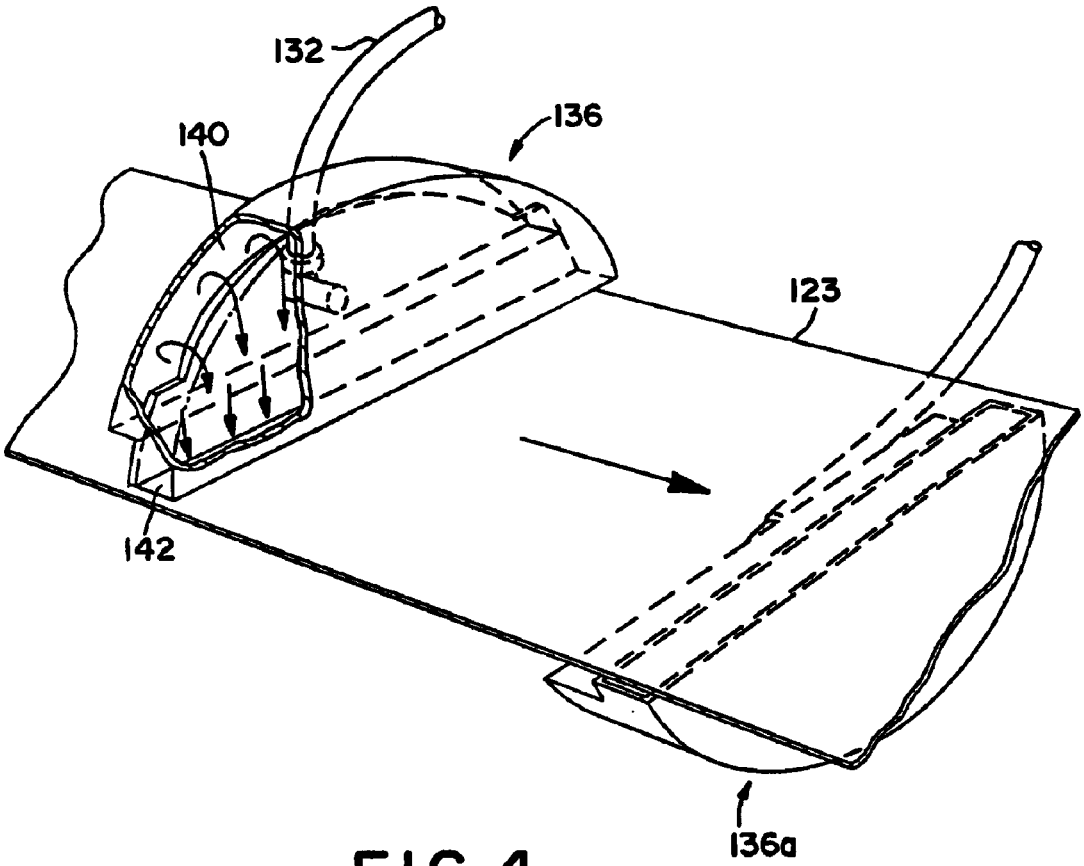
FIG. 4 is a perspective view of one embodiment of top and bottom foam applicators used to foam latex onto a paper web.

Referring to FIGS. 3–4, a foam applicator that can be used to apply the foam to the dried web is illustrated. As shown, the foam applicator 136 contains a distribution chamber 140 and an extrusion head 142. Any of a variety of distribution chambers and/or extrusion heads can be utilized in a foam applicator of the present invention.

For example, as shown, in one embodiment, the distribution chamber 140 is substantially parabolic in shape. In this embodiment, the substantially parabolic shape can allow the foam bubbles to travel the same distance, at the same velocity, for the same length of time, thereby enhancing the uniformity of foam application. It should be understood, however, that the present invention is not limited to any specific distribution chamber design. For example, one example of a suitable distribution chamber is described in U.S. Pat. No. 4,237,818 to Clifford, et al., which is incorporated herein in its entirety by reference thereto.

As the foam enters the distribution chamber 140 from the conduit 132, it is initially forced upward to assure that any decaying foam collects therein for automatic draining. Thereafter, it is forced downward, as indicated by the arrows in FIG. 4, through the distribution chamber 140 to the extrusion head 142. In general, extrusion heads having any of a variety of shapes and sizes can be used in the present invention. For example, in one embodiment, "straight slot" extrusion heads, such as disclosed in U.S. Pat. No. 4,237,818 to Clifford, et al. and U.S. Pat. No. 4,581,254 to Cunnigham, et al., which are incorporated herein in their entirety by reference thereto for all purposes, can be utilized. As used herein, a "straight slot" extrusion head generally refers to an application head having parallel nozzle bars. In one embodiment, for example, a "straight slot" extrusion head includes two parallel nozzle bars that form an extrusion slot which is generally from about 0.025 inches to about 0.5625 inches in width, and in some embodiments, from about 0.050 inches to about 0.0626 inches in width. For instance, in one embodiment, the width is about 0.125 inches. In another embodiment, the width is about 0.1875 inches.

Moreover, the length of the bars is typically such that the extrusion slot has a length from about 0.125 inches to about 6 inches. The length of the slot, however, can be varied as desired to adjust the web handling land area. For example, in one embodiment, the length of the extrusion slot can be about 0.187 inches. In addition, a wiper plate can also be attached to one or both of the nozzle bars to help adhere the foam to the web.

If desired, one or both of the upper lips of the parallel bars of the extrusion head can also be configured to apply a certain amount of tension to the web when contacted therewith. For instance, in one embodiment, as a web is pulled over the foam applicator, it first contacts a first upper lip of one parallel nozzle bar and then contacts a second upper lip of the other parallel nozzle bar. As the web is pulled over the first and second upper lips, foam can be applied to the bottom surface of the web through the extrusion slot defined by the parallel nozzle bars.

In general, the size of the upper lips can be varied as desired. For instance, the upper lips can have a radius up to about 0.50 inches. In some embodiments, it may be desired to utilize a first upper lip having a relatively narrow radius, such as less than about 0.01 inches, and more particularly less than about 0.05 inches. By utilizing a relatively narrow first upper lip, a high pressure point can be created. This high pressure point allows the "boundary air layer" located directly below the web to be minimized. As used herein, a "boundary air layer" generally refers to a layer of air located adjacent to a moving web. Because webs used in tissue formation typically have relatively low basis weights and strengths, boundary air layers often inhibit the ability to control the position of the traveling web. As such, by minimizing the boundary air layer, such as described above, the efficiency of foam application can be enhanced. It should be understood that various other mechanisms can be utilized to minimize the boundary air layer. For example, in some embodiments, vacuum rolls or boxes can be utilized to remove the boundary air layer.

Moreover, it should also be understood that any method or apparatus for applying a foam to a web can be used in the present invention, and that the foam applicator depicted and described herein is for illustrative purposes only. For instance, some suitable foam applicators are described in U.S. Pat. No. 4,237,818 to Clifford, et al. and U.S. Pat. No. 4,581,254 to Cunnigham, et al.

Referring again to FIG. 4, the foam is generally extruded onto the moving web 123 from the extrusion head 142, as described above. In particular, by exerting sufficient tension in the moving web, it can generally be kept in uniform contact with the upper surfaces of the head 142 against the pressure of the foam within the head 142. Thus, as it moves, the web 123 can "tear away" portions of the foam bubbles located near the upper surfaces of the head 142. Moreover, small portions of the foam bubbles can also be blown onto the web. Specifically, the foam bubbles remain under pressure until the instant of application to tissue web 123 so that the liquid forming the bubbles can be blown onto the substrate by the rapidly expanding air released from the bubbles. In some embodiments, excess foam can also be collected by collection troughs 155 and recycled through a line 156.

Although the use of only one foam applicator 136 is described in detail herein, it should be understood that any number of foam applicators may be used. For instance, as shown in FIG. 4, a first foam applicator 136 is shown as depositing a foam composition onto the top surface of the web 123, while a second applicator 136*a* is shown as depositing a foam composition on the bottom surface of the web 123. The foam applicator 136*a* may be the same or different than the foam applicator 136. Moreover, although not required, it is typically desired that the foam applicators 136 and 136*a* be positioned in a staggered configuration so that the web 123 can be better deflected around the applicators. It should also be understood that other applicators can be utilized in conjunction with the applicators 136 and 136*a* to deposit foam compositions onto the top and/or bottom surfaces of the web 123.

In general, any of a variety of process parameters may be controlled to ensure adequate foaming. For example, process parameters, such as tissue web traverse speed, web tension, tissue basis weight, etc., may be controlled. For instance, in one embodiment, the web traverse speed can be greater than about 300 feet per minute, and particularly from about 300 feet per minute to about 2500 feet per minute.

Moreover, the flow rates of the latex, air, and/or water can also be controlled. By controlling the flow rates of air, water, and/or the latex stream, certain characteristics of the generated foam can be selectively varied as desired. For example, control over these flow rates can be utilized to control the "blow ratio" of the resulting foamed composition. As used herein, the "blow ratio" generally refers to the ratio of air volume to liquid volume in the foam. In particular, the blow ratio represents the volume of air that a given liquid can support. For example, a relatively high blow ratio is generally associated with foam bubbles having a smaller wall thickness. On the other hand, a relatively low blow ratio is generally associated with foam bubbles having a larger wall thickness. In most embodiments, it is typically desired that a relatively high blow ratio be utilized in the present invention. For example, although not required, a foam generation system of the present invention can utilize blow ratios greater than about 3:1, and particularly from about 5:1 to about 180:1. For example, in some embodiments, a blow ratio of about 150:1 to about 180:1 is utilized, while in other embodiments, a blow ratio of about 15:1 to about 25:1 is utilized. For instance, in one particular embodiment, a blow ratio of about 30:1 is obtained from a liquid flow rate of 113 grams per minute and an air flow rate of 3831 cubic centimeters per minute. In another embodiment, a blow ratio of about 20:1 was obtained from a liquid flow rate of 248 grams per minute and an air flow rate of 4800 cubic centimeters per minute.

In addition, the flow rates of the air, water, and/or the latex can also be controlled to ensure that the resulting foam is "generally stable". As used herein, a "generally stable" foam generally refers to a foam that does not substantially dewater or collapse from the time it is generated to the time it is applied to the tissue. For example, a generally stable foam typically has a "half-life" that allows the foam to travel from the foam generator to the applicator before degenerating. For instance, a foam bubble of the present invention can have a half-life of greater than about 3 minutes, particularly from about 3 minutes to about 30 minutes, and more particularly from about 15 minutes to about 25 minutes.

The half-life of the foam can generally be determined in the following manner. A calibrated beaker is positioned on a scale and placed under a 500 cubic centimeter separator funnel. Approximately 50 grams of a foam sample is then collected into the separator funnel. As soon as all of the foam is placed in the funnel, a standard stop watch is started. When approximately 25 grams of liquid collects into the calibrated beaker, the time is stopped and recorded. This recorded time is the foam half-life.

In some instances, the average cell size, wall thickness, and/or density may also foster the stability of the foam. For instance, the foam can have a size, thickness, or density such as described in U.S. Pat. No. 4,099,913 to Walter et al. and U.S. Pat. No. 5,985,434 to Qin, et al., which are both incorporated herein in their entirety by reference thereto for all purposes. For example, in one embodiment, the average cell size of the foam cell can be from about 10 microns to about 100 microns. Moreover, the average wall thickness of the foam cell can be from about 0.1 micron to about 30 microns.

As shown in FIG. 3, a system controller 150 can be provided to control the process parameters of the foaming system. In particular, various controlled, controlling, and monitoring elements can be placed in communication with the system controller 150. For instance, although not depicted, solenoid valves, other valves, pumps, the foam generator, flowmeters, transducers, and the like, can all be placed in communication with the controller 150. In one embodiment, for example, the flow rates of the latex, water, and/or air being supplied to the foam generator system 124, can be controlled by the controller 150.

Figure 5:
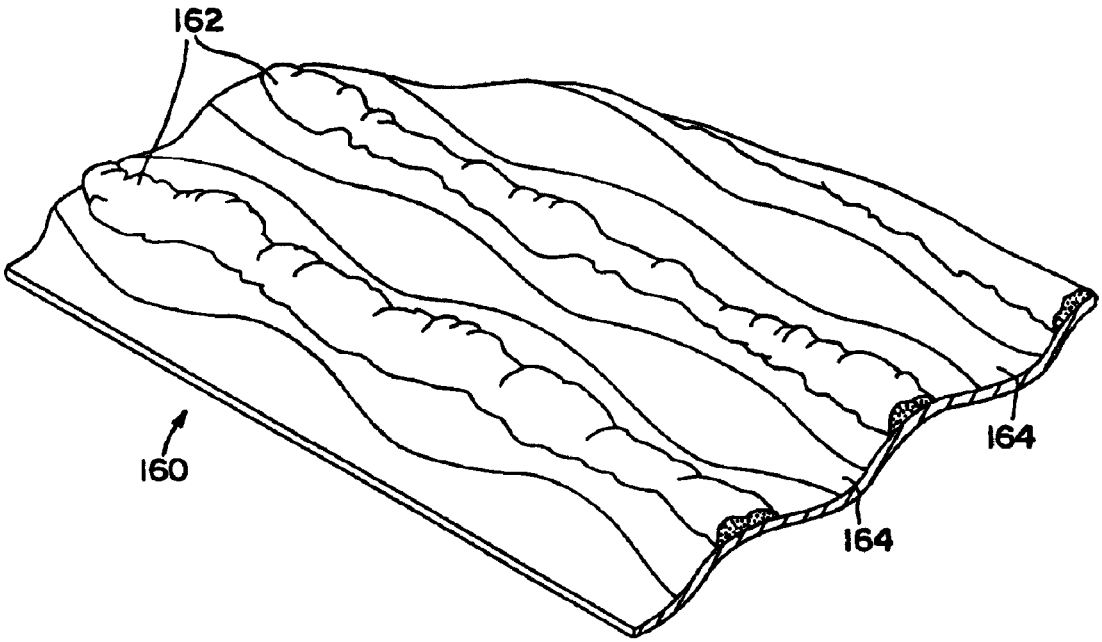
FIG. 5 is a perspective view of a paper web having elevated regions applied with latex according to one embodiment of the present invention.

In some embodiments, the latex can be deposited primarily on the elevated regions of the surface of a tissue. For example, as shown in FIG. 5, the latex can be deposited as a foam composition such that a greater amount of the composition resides on the elevated regions 162 of a web 160 than on the non-elevated regions 164. Such elevated regions 162 and non-elevated regions 164 may be imparted by an uncreped, through-drying papermaking process, such as described above. Application of the latex to primarily the elevated regions 162 of the web can place the chemistry where it is typically most needed, i.e., at the locations where the web contacts a surface during use. Moreover, because the placement of the latex is focused primarily on the elevated regions 162, a lower total amount of latex may be utilized than would otherwise be required to reduce slough by uniformly applying the latex to the web surface. Thus, slough can be reduced without increasing the stiffness of the web.

By incorporating uncured latex into the multi-layered paper web, the strength and stiffness imparted to the tissue product can be appropriately balanced as desired. Moreover, the resulting tissue product can be strong and produce a relatively low amount of lint and slough, while also maintaining the flexibility and softness desired for many end uses of the tissue product.

The present invention may be better understood with reference to the following examples.

Test Methods

The tensile strength, slough, and stiffness of the samples set forth in the Examples were determined as follows.

Tensile Strength

Tensile strength was reported as "GMT" (grams per 3 inches of a sample), which is the geometric mean tensile strength and is calculated as the square root of the product of MD tensile strength and CD tensile strength. MD and CD tensile strengths were determined using a MTS/Sintech tensile tester (available from the MTS Systems Corp., Eden Prairie, Minn.). Tissue samples measuring 3 inch wide were cut in both the machine and cross-machine directions. For each test, a sample strip was placed in the jaws of the tester, set at a 4 inch gauge length for facial tissue and 2 inch gauge length for bath tissue. The crosshead speed during the test was 10 in./minute. The tester was connected with a computer loaded with data acquisition system; e.g., MTS TestWork for windows software. Readings were taken directly from a computer screen readout at the point of rupture to obtain the tensile strength of an individual sample.

Slough

Figure 6:
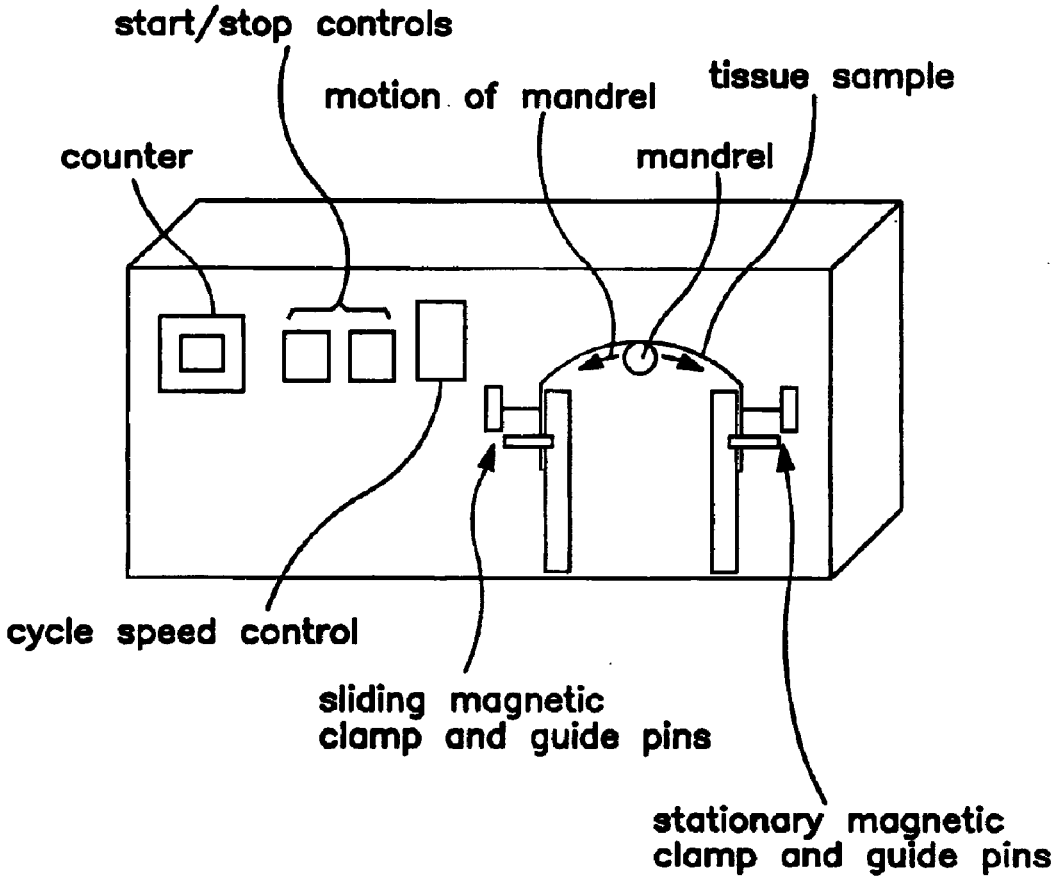
FIG. 6 is a schematic illustration of one example of an apparatus that can be used to measure the slough of a tissue product.

In order to determine the abrasion resistance or tendency of the fibers to be rubbed from the web when handled, each sample was measured by abrading the tissue specimens via the following method. This test measures the resistance of tissue material to abrasive action when the material is subjected to a horizontally reciprocating surface abrader. All samples were conditioned at 23° C.±1° C. and 50±2% relative humidity for a minimum of 4 hours. FIG. 6 shows a diagram of the test equipment.

The abrading spindle contained a stainless steel rod, 0.5" in diameter with the abrasive portion consisting of a 0.005" deep diamond pattern extending 4.25" in length around the entire circumference of the rod. The spindle was mounted perpendicularly to the face of the instrument such that the abrasive portion of the rod extends out its entire distance from the face of the instrument. On each side of the spindle were located guide pins with magnetic clamps, one movable and one fixed, spaced 4" apart and centered about the spindle. The movable clamp and guide pins were allowed to slide freely in the vertical direction, the weight of the jaw providing the means for insuring a constant tension of the sample over the spindle surface.

Using a die press with a die cutter, the specimens were cut into 3"±0.05" wide×8" long strips with two holes at each end of the sample. For the tissue samples, the MD direction corresponds to the longer dimension. Each test strip was then weighed to the nearest 0.1 mg. Each end of the sample was slid onto the guide pins and magnetic clamps held the sheet in place. The movable jaw was then allowed to fall providing constant tension across the spindle.

The spindle was then moved back and forth at an approximate 15 degree angle from the centered vertical centerline in a reciprocal horizontal motion against the test strip for 20 cycles (each cycle is a back and forth stroke), at a speed of 80 cycles per minute, removing loose fibers from the web surface. Additionally, the spindle rotated counter clockwise (when looking at the front of the instrument) at an approximate speed of 5 RPMs. The magnetic clamp was then removed from the sample and the sample was slid off of the guide pins and any loose fibers on the sample surface are removed by blowing compressed air (approximately 5–10 psi) on the test sample. The test sample was then weighed to the nearest 0.1 mg and the weight loss calculated. Ten test samples per tissue sample were tested and the average weight loss value in milligrams was recorded.

Stiffness

Stiffness (or softness) was ranked on a scale from 0 to 16, where lower values represent softer tissues and higher values represent stiffer tissues. Twelve (12) panelists were asked to consider the amount of pointed, rippled or cracked edges or peaks felt from the sample while turning in your hand. The panelists were instructed to place two tissue samples flat on a smooth tabletop. The tissue samples overlapped one another by 0.5 inches (1.27 centimeters) and were flipped so that opposite sides of the tissue samples were represented during testing. With forearms/elbows of each panelist resting on the table, they placed their open hand, palm down, on the samples. Each was instructed to position their hand so their fingers were pointing toward the top of the samples, approximately 1.5 inches (approximately 3.81 centimeters) from the edge. Each panelist moved their fingers toward their palm with little or no downward pressure to gather the tissue samples. They gently moved the gathered samples around in the palm of their hand approximately 2 to 3 turns. The rank assigned by each panelist for a given tissue sample was then averaged and recorded.

EXAMPLE 1

The ability to produce a web that has low amounts of slough was demonstrated. Four tissue samples (Samples 1–4) were produced on a papermaking machine, such as illustrated in FIG. 1.

The web was a single-ply, three-layered uncreped throughdried bath tissue made using eucalyptus fibers for the outer layers and softwood fibers for the inner layer. Prior to pulping, a quaternary ammonium softening agent (C6027 from Goldschmidt Corp.) was added at a dosage of 4.1 kg/Mton of active chemical per metric ton of fiber to the eucalyptus furnish. After allowing 20 minutes of mixing time, the slurry was dewatered using a belt press to approximately 32% consistency. The filtrate from the dewatering process was either sewered or used as pulper make-up water for subsequent fiber batches, but not sent forward in the stock preparation or tissue-making process. The thickened pulp containing the debonder was subsequently redispersed in water and used as the outer layer furnishes in the tissue-making process.

The softwood fibers were pulped for 30 minutes at 4% solids consistency and diluted to 3.2% solids consistency after pulping, while the debonded eucalyptus fibers were diluted to 2% solids consistency. The overall layered sheet weight was split 20%/60%/20% among the eucalyptus/refined softwood/eucalyptus layers. The center layer was refined with 1.2 HPD/T to achieve target strength values, while the outer layers provided the surface softness and bulk.

A three layer headbox was used to form the wet web with the refined northern softwood kraft stock in the two center layers of the head box to produce a single center layer for the three-layered product described. Turbulence-generating inserts recessed about 3 inches from the slice and layer dividers extending about 1 inch beyond the slice were employed. The net slice opening was about 0.9 inch and water flows in all four headbox layers were comparable. The consistency of the stock fed to the headbox was about 0.09 weight percent The resulting three-layered sheet was formed on a twin wire, suction form roll, former with forming fabrics Lindsay 2164 and Asten 867a forming fabrics. The speed of the forming fabrics was 2000 feet per minute. The newly-formed web was then dewatered to a solids consistency of about 20–27% using vacuum suction from below the forming fabric before being transferred to the transfer fabric, which was traveling at 1600 feet per minute (25% rush transfer). The transfer fabric was an Appleton Wire T807-1. A vacuum shoe pulling about 6–15 inches (150–380 millimeters) of mercury vacuum was used to transfer the web to the transfer fabric.

The web was then transferred to a throughdrying fabric (Lindsay Wire T1205-1). The throughdrying fabric traveled at a speed of about 1600 feet per minute. The web was carried over a Honeycomb throughdryer operating at a temperature of about 175° C. and dried to final dryness of about 94–98% solids consistency. The resulting uncreped tissue sheet was then wound into a parent roll.

The parent roll was then unwound and the web was calendered twice. At the first station the web was calendered between a steel roll and a rubber covered roll having a 4 P&J hardness. The calender loading was about 90 pounds per lineal inch (pli). At the second calendering station, the web was calendered between a steel roll and a rubber covered roll having a 40 P&J hardness. The calender loading was about 140 pli. The thickness of the rubber covers was about 0.725 inch.

The calendered single-ply web was then fed into the rubber-rubber nip of a rotogravure laboratory coater (available from RETROFLEX, INC, DePere, Wis.) to apply Airflex A-105, a vinyl-acetate ethylene co-polymer latex available from Air Products, Inc. to each side of the sample.

Samples 1–4 contained latex amounts of 0 lb/T, 2.5 lb/T, 5 lb/T, and 10 lb/T. The gravure rolls were electronically engraved and had a volume of 4.0 Billion Cubic Microns (BCM) per square inch of roll surface. The rubber rolls had a 6-inch diameter with ⅜ inch thickness covered with a 75 Shore A durometer cast polyurethane supplied by American Roller Company. The gravure printer was run at a speed of 100 feet per minute. The resulting samples had a latex concentration of 0%, 0.125%, 0.25%, and 0.5% by weight of the dry fibrous material within the web.

The tissue samples were then converted into bath tissue rolls. Once converted, the slough and panel stiffness of the converted bath tissue samples were determined.

The results are provided below in Table 1.

TABLE 1

| Sample Results | | | | |
|---|---|---|---|---|
| Sample | Latex % | Slough (mg) Dryer Side | Slough (mg) Air Side | Panel Stiffness |
| 1 | 0 | 9.7 | 9.5 | 5.5 |
| 2 | 0.125 | 8.9 | 8.7 | 5.6 |
| 3 | 0.250 | 5.5 | 5.1 | 5.8 |
| 4 | 0.500 | 4.7 | 4.2 | 6.2 |

As indicated, the slough decreased upon application of greater levels of latex. In addition, the stiffness of the web was not substantially increased.

EXAMPLE 2

The ability to produce a web that has low amounts of slough was demonstrated. Initially, four uncreped, through-dried tissue samples (Samples 14) were produced as set forth above in Example 1.

Airflex A-105, a vinyl-acetate ethylene co-polymer latex available from Air Products, Inc., was initially diluted to 15% solid content. The latex was dyed with a blue dye. In addition, Mackernium 516, a foaming aid available from McIntyre Group, Ltd., was also diluted to 15% solid content. The latex and foaming aid were mixed together to form a mixture of 4 parts latex and 1 part foaming aid.

This mixture was applied to the dryer side of the tissue samples using a foam applicator such as described above and shown in FIGS. 3–4. Two latex amounts were tested, i.e., 4 lb/ton and 8 lb/ton. The liquor flow rate of the mixture supplied to the foam applicator was 50 milliliters/minute (for 4 lb/ton latex samples) and 100 milliliters/minute (for 8 lb/ton latex samples). A blow ratio of 24 and a web speed of 1000 ft/minute were used during foam deposition. The resulting samples had a latex concentration of 0.20% and 0.4% by weight of the dry fibrous material within the web.

The results are provided below in Table 2.

TABLE 2

| Sample Results | | | |
|---|---|---|---|
| Sample | Latex % | Foaming Aid (lb/T) | Slough (mg) Dryer Side |
| 1 | 0 | 0 | 9.5 |
| 2 | 0.20 | 1.0 | 8.2 |
| 3 | 0.40 | 2.0 | 6.3 |

Figure 7:
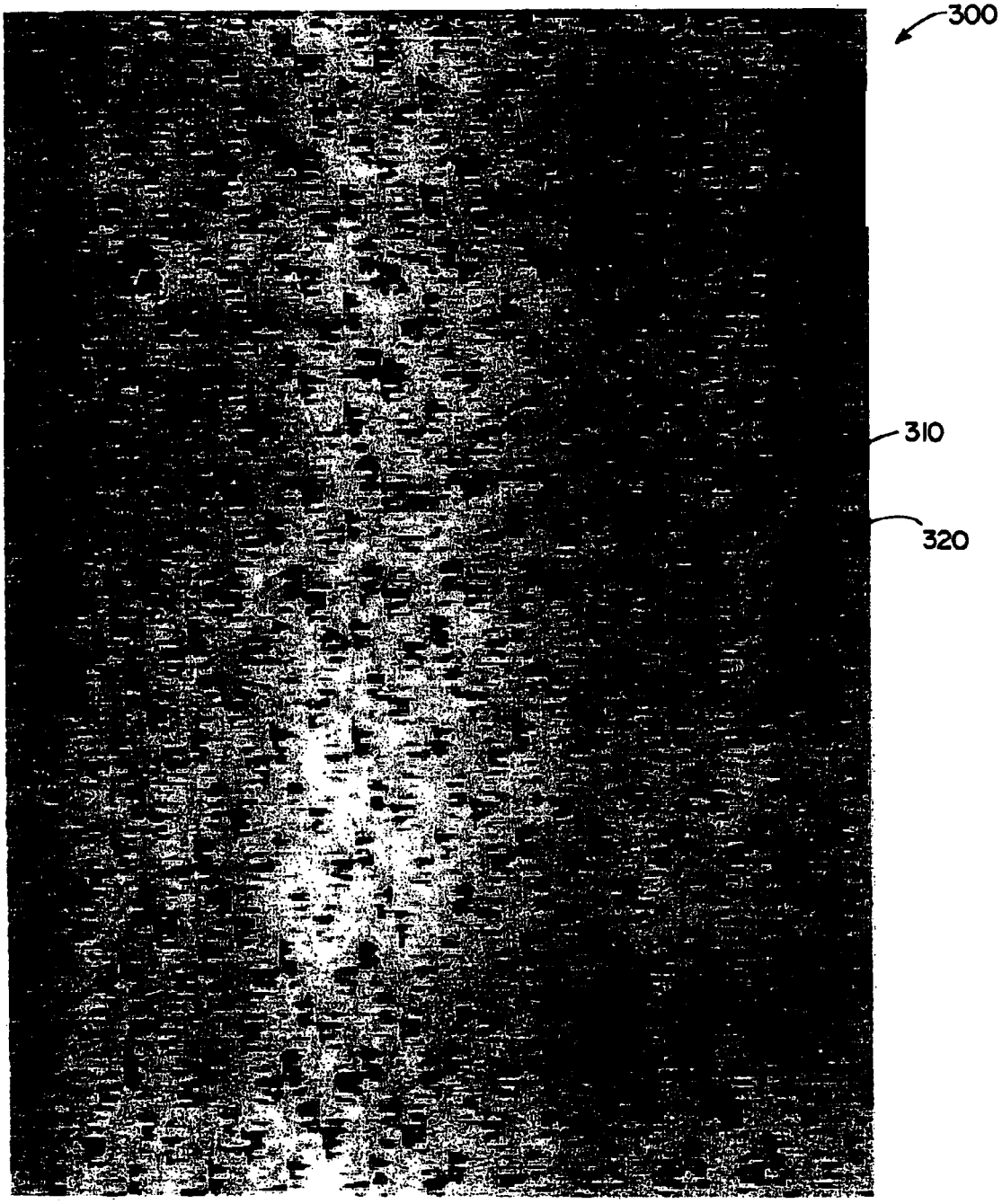
FIG. 7 is a photograph of the tissue sample formed in Example 2.

As indicated, the slough decreased upon application of greater levels of latex. Moreover, the latex was deposited on primarily the elevated regions formed on the uncreped through-dried tissue sample. Specifically, as shown in FIG. 7, the elevated regions 310 of the tissue sample 300 were deposited with the dyed latex, while the non-elevated regions 320 remained relatively free of the latex.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A tissue product comprising a multi-layered paper web having at least one outer layer that defines an outer surface of the tissue product, said outer layer being formed from cellulosic fibers, wherein said outer layer comprises a substantially uncured latex having a glass transition temperature less than about 30° C. and greater than about −25° C., where said latex comprises less than about 2% of the dry weight of said web.

2. A tissue product as defined in claim 1, wherein said latex comprises from about 0.1% to about 1.5% of the dry weight of said web.

3. A tissue product as defined in claim 1, wherein said latex comprises from about 0.5% to about 1% of the dry weight of said web.

4. A tissue product as defined in claim 1, wherein one or more of the remaining layers of said multi-layered paper web are substantially free of said latex.

5. A tissue product as defined in claim 1, wherein the tissue product has a basis weight less than about 80 grams per square meter.

6. A tissue product as defined in claim 1, wherein said latex is selected from the group consisting of styrene-butadien copolymers, polyvinyl acetate homopolymers, vinyl-acetate ethylene copolymers, vinyl-acetate acrylic copolymers, ethylene-vinyl chloride copolymers, ethylene-vinyl chloride-vinyl acetate terpolymers, acrylic polyvinyl chloride polymers, acrylic polymers, and nitrile polymers.

7. A tissue product as defined in claim 1, wherein said outer layer further comprises a debonder, a strength agent, or combinations thereof.

8. A tissue product as defined in claim 1, wherein said multi-layered web is an uncreped, through-dried web.

9. A tissue product as defined in claim 1, wherein said surface of said multi-layered web has elevated regions and non-elevated regions, said latex being applied to said through-dried web such that a greater amount of said latex resides on said elevated regions than on said non-elevated regions.

10. A tissue product comprising a through-dried, multi-layered paper web having at least one outer fibrous layer that defines an outer surface of the tissue product, wherein said surface of said multi-layered web has elevated regions and non-elevated regions, wherein said outer layer comprises a substantially uncured latex such that a greater amount of said latex resides on said elevated regions than on said non-elevated regions, said latex having a glass transition temperature less than about 30° C. and greater than about −25° C., where said latex comprises less than about 2% of the dry weight of said web.

11. A tissue product as defined in claim 10, wherein said latex comprises from about 0.1% to about 1.5% of the dry weight of said web.

12. A tissue product as defined in claim 10, wherein said latex comprises from about 0.5% to about 1% of the dry weight of said web.

13. A tissue product as defined in claim 10, wherein one or more of the remaining layers of said multi-layered paper web are substantially free of said latex.

14. A tissue product as defined in claim 10, wherein said outer layer further comprises a debonder, a strength agent, or combinations thereof.

15. A tissue product as defined in claim 10, wherein the tissue product is uncreped.

16. A tissue product comprising a through-dried, multi-layered paper web having at least one outer fibrous layer that defines an outer surface of the tissue product, wherein said surface of said multi-layered web has elevated regions and non-elevated regions, wherein said outer layer comprises a substantially uncured latex such that a greater amount of said latex resides on said elevated regions than on said non-elevated regions, said latex having a glass transition temperature less than about 30° C. and greater than about −25° C., wherein said latex comprises from about 0.1% to about 1.5% of the dry weight of said web, and wherein one or more of the remaining layers of said multi-layered paper web are substantially free of said latex.

17. A tissue product as defined in claim 16, wherein said latex comprises from about 0.5% to about 1% of the dry weight of said web.

18. A tissue product as defined in claim 16, wherein said outer layer further comprises a debonder, a strength agent, or combinations thereof.

19. A tissue product as defined in claim 16, wherein the tissue product is uncreped.

* * * * *

UNITED STATES PATENT AND TRADEMARK OFFICE

CERTIFICATE OF CORRECTION

PATENT NO. : 6,929,714 B2
APPLICATION NO. : 10/830627
DATED : August 16, 2005
INVENTOR(S) : Sheng-Hsin Hu et al.

It is certified that error appears in the above-identified patent and that said Letters Patent is hereby corrected as shown below:

Title page, item [57] Abstract: “30° C,” should be --“30° C”--
Column 18, lines 18 and 60, “-25°.” should be --“-25°”--
Column 20, line 2, “-25°.” should be --“25°”--

Signed and Sealed this

Sixth Day of February, 2007

JON W. DUDAS
*Director of the United States Patent and Trademark Office*